US008709266B2

(12) United States Patent
Kokubo et al.

(10) Patent No.: US 8,709,266 B2
(45) Date of Patent: Apr. 29, 2014

(54) METHOD OF MANUFACTURING SUBSTRATE FOR LIQUID DISCHARGE HEAD

(75) Inventors: Satoshi Kokubo, Kawasaki (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 649 days.

(21) Appl. No.: 12/721,046

(22) Filed: Mar. 10, 2010

(65) Prior Publication Data

US 2010/0255616 A1 Oct. 7, 2010

(30) Foreign Application Priority Data

Apr. 1, 2009 (JP) ..... 2009-088965

(51) Int. Cl.
*B41J 2/14* (2006.01)
*B44C 1/22* (2006.01)

(52) U.S. Cl.
USPC ..... 216/27; 216/17; 216/41; 216/83

(58) Field of Classification Search
USPC ..... 216/17, 27, 41, 83
See application file for complete search history.

(56) References Cited

U.S. PATENT DOCUMENTS 5,116,457 A * 5/1992 Jerman ..... 438/53
5,658,471 A 8/1997 Murthy et al.
6,468,437 B1 10/2002 Kashino et al.
6,521,137 B2 2/2003 Kubota et al.
6,951,380 B2 10/2005 Kubota et al.
7,090,325 B2 * 8/2006 Hashimoto et al. ..... 347/20
7,105,097 B2 * 9/2006 Hess ..... 216/27
7,198,726 B2 * 4/2007 Donaldson et al. ..... 216/27
7,824,560 B2 * 11/2010 Sakai et al. ..... 216/2
2005/0103758 A1 5/2005 Otis et al.
2005/0136668 A1 * 6/2005 Yotsuya ..... 438/689
2006/0032841 A1 * 2/2006 Tan et al. ..... 219/121.69
2007/0212891 A1 * 9/2007 Yamamuro et al. ..... 438/733
2009/0065481 A1 * 3/2009 Kishimoto et al. ..... 216/87

FOREIGN PATENT DOCUMENTS

JP 2009061667 * 3/2009

* cited by examiner

*Primary Examiner* — Shamim Ahmed
(74) *Attorney, Agent, or Firm* — Fitzpatrick, Cella, Harper & Scinto

(57) ABSTRACT

A method of manufacturing a substrate for a liquid discharge head having a supply port passing through a silicon substrate provided with an energy-generating element generating the energy used to discharge a liquid and allowing liquid to be supplied to the energy-generating element, includes preparing a silicon substrate in which a first etching mask having a first opening is provided on a first face, and a second etching mask having a second opening is provided on a second face that is the rear face of the first face; forming a first recess towards the second face from the first face within the first opening, and forming a second recess towards the first face from the second face within in the second opening; and performing crystalline anisotropic etching using the first and second etching masks as masks from both of the first and second faces, to form the supply port.

7 Claims, 6 Drawing Sheets

METHOD OF MANUFACTURING SUBSTRATE FOR LIQUID DISCHARGE HEAD

BACKGROUND OF THE INVENTION

1. Field of the Invention

The present invention relates to a method of manufacturing a substrate used for a liquid discharge head which applies energy to a liquid, such as ink, thereby discharging the liquid.

2. Description of the Related Art

Generally, an ink jet head is heated by a pressure generator, for example, a heater board for discharging ink, whereby components of an ink composition are evaporated to generate pressure to discharge ink. Additionally, generally, ink is supplied from the rear face of a substrate for an ink jet head in which the pressure generator is provided. For this reason, the ink jet head substrate is provided with an ink supply port for allowing a surface and a rear face to fluidly communicate with each other.

As a method for forming an ink supply port in a substrate for an ink jet head, for example, U.S. Pat. No. 5,658,471 discloses using anisotropic etching by taking advantage of the features of a single crystal silicon substrate that is a substrate material for an ink jet head. Additionally, US Patent Application Publication No. 2005/0103758 discloses a method of using laser beam machining.

In a case where a substrate for an ink jet head described in US Patent Application Publication No. 2005/0103758 is machined using a laser to form an ink supply port, an ink supply port which has a wall surface vertical to a substrate surface can be obtained. However, in a single crystal silicon substrate which is widely used as a material for the substrate for an ink jet head, the surface vertical to the substrate surface generally does not become a crystal plane. For this reason, depending on the composition of ink, the wall surface of the ink supply port may be etched by the ink. If components of the substrate are eluted into ink, the drawing performance of the ink jet head may be unstable, or defects such as clogging of an ink flow channel may occur.

On the other hand, according to the method of forming an ink supply port by anisotropic etching disclosed in U.S. Pat. No. 5,658,471, the wall surface of the ink supply port can be a crystal plane which is stable against ink, and the aforementioned problem does not occur. However, in the method of forming an ink supply port in a substrate for an ink jet head made from single crystal silicon as disclosed in Patent Document 1, an etching mask was given to one face (rear face) of the substrate, and anisotropic etching is performed from one side (rear face). Therefore, the cross-section of an ink supply port 60 which communicates with discharge ports 30 is formed in a tapered shape due to the inclination of the crystal plane to the substrate surface. Therefore, the opening width in the rear face becomes significantly larger than the opening width in the surface of the substrate for an ink jet head (refer to FIG. 2). As a result, there is a problem in that size of the substrate for an ink jet head cannot be made small.

SUMMARY OF THE INVENTION

The present invention was made in view of the above problem. One object of the present invention is to provide a miniaturized substrate for a liquid discharge head with shortened manufacturing time.

The present invention provides a method of manufacturing a substrate for a liquid discharge head having a supply port which passes through a silicon substrate provided with an energy-generating element which generates the energy used to discharge a liquid and which allows the liquid to be supplied to the energy-generating element therethrough. The method includes preparing a silicon substrate in which a first etching mask having a first opening is provided on a first face, and a second etching mask having a second opening is provided on a second face that is a rear face of the first face; forming a first recess towards the second face from the first face within the first opening, and forming a second recess towards the first face from the second face within in the second opening; and performing crystalline anisotropic etching using the first and second etching masks as masks from both the faces of the first and second faces, thereby forming the supply port.

According to the present invention, leading holes are formed in etching regions of both faces of a silicon substrate before anisotropic etching is performed, so that the difference between opening widths in first and second faces can be made smaller, and the size of the substrate for a liquid discharge head can be reduced. Additionally, the etching time can be shortened.

This enables the productivity of liquid discharge heads to be greatly improved.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Additionally, although the following description will be made taking a substrate for an ink jet head as an example as an example of application of the present invention, the range of application of the present invention is not limited thereto, and can be applied also to a substrate for a liquid discharge head for biochips or electronic circuit printing. The liquid discharge head also includes, for example, a head for manufacture of color filters besides the ink jet head.

Figure 1:
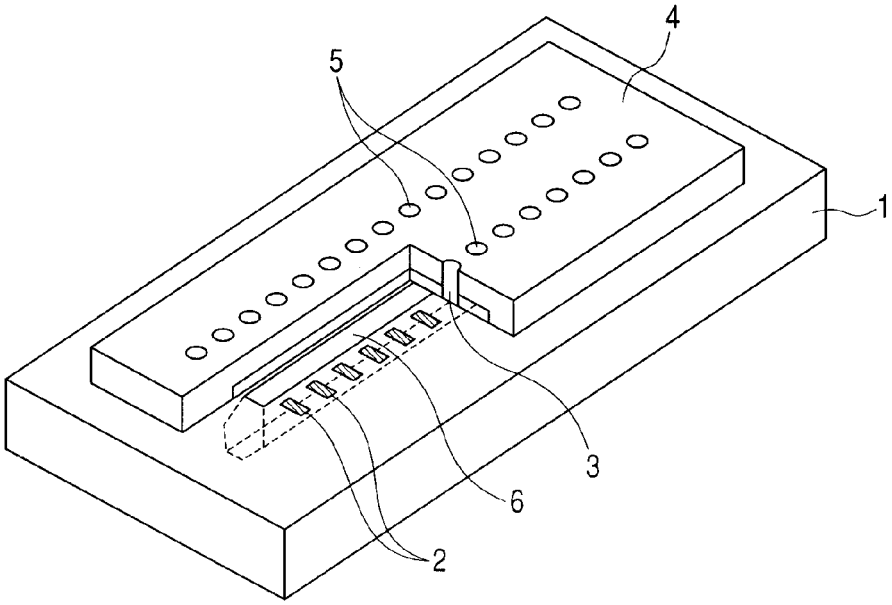
FIG. 1 is a schematic perspective view for describing the configuration of an ink jet head according to an embodiment of the present invention.

A schematic diagram of an ink jet head using a substrate for an ink jet head of the present invention is illustrated in FIG. 1.

In FIG. 1, the ink jet head has a silicon substrate 1 as the substrate for an ink jet head in which two rows of discharge energy generating elements 2 are aligned and formed at predetermined pitches. A coating resin layer 4 which forms an ink flow channel 3 is provided on the silicon substrate 1. The ink flow channel 3 communicates with discharge ports 5 through which ink is discharged, and ink is supplied to the ink flow channel 3 from an ink supply port 6. This ink jet head applies the energy generated by a discharge energy generating element 2 to the ink filled into the ink flow channel 3 via the ink supply port 6, thereby making an ink droplet be discharged from a discharge port 5 and adhere to a recording medium, thereby performing recording.

Embodiment 1

Figure 4A:
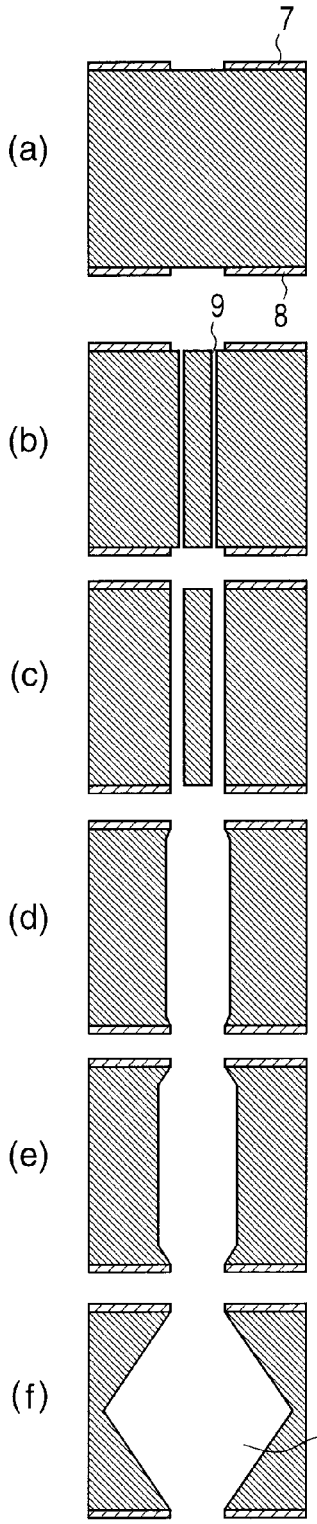
FIGS. 4A and 4B are schematic process charts for describing an example of the method of manufacturing a substrate for a liquid discharge head in Embodiment 1.
Figure 4B:
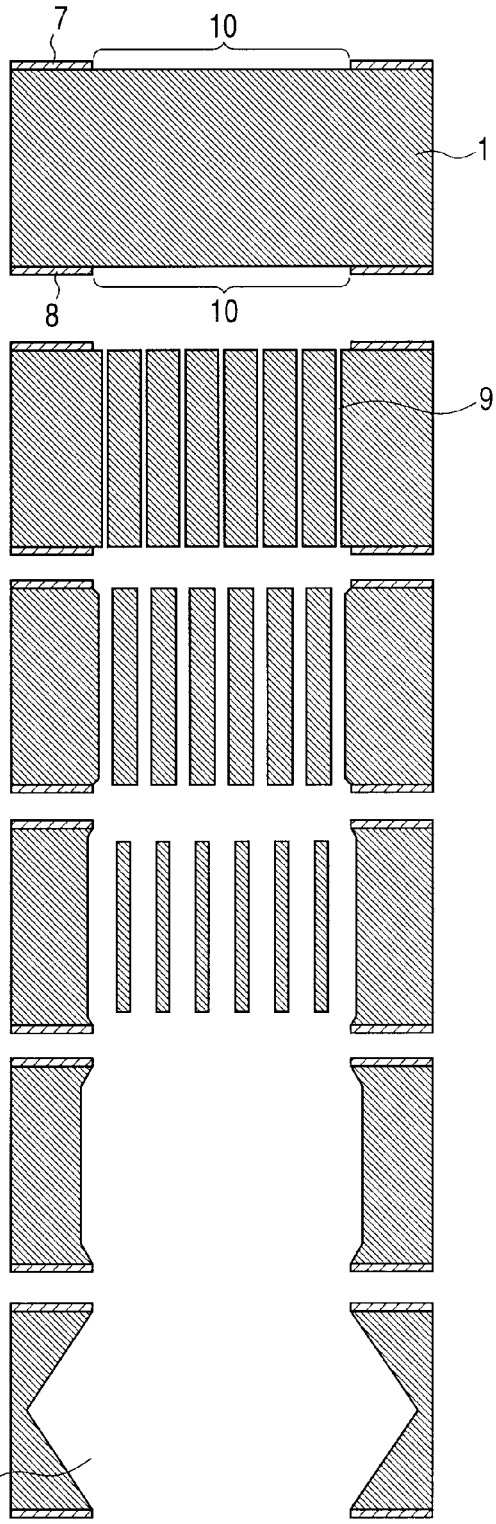
Figure 5:
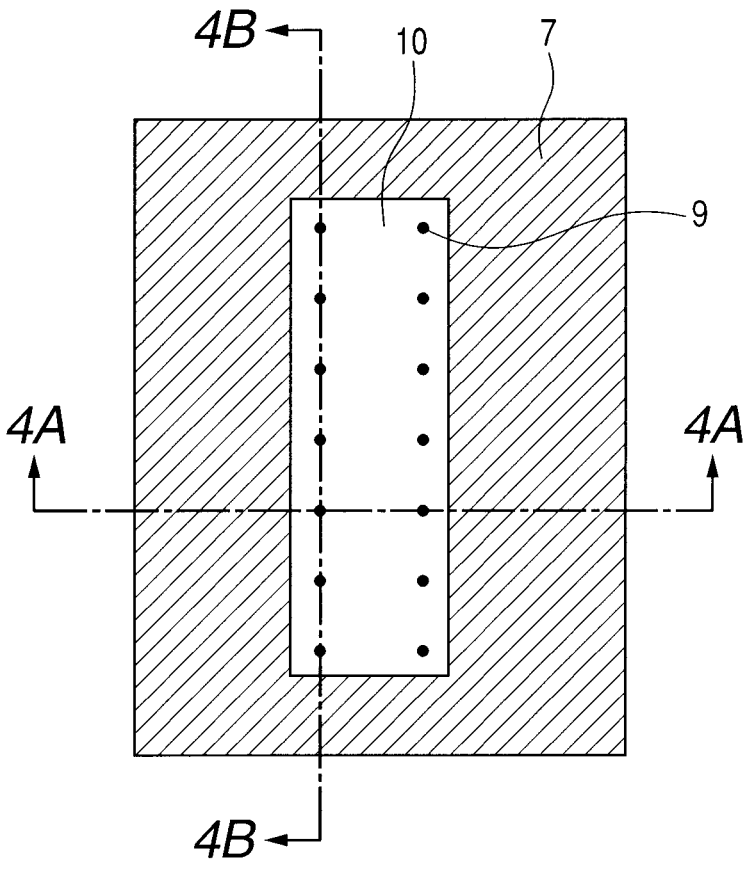
FIG. 5 is a schematic diagram illustrating an example of formation of etching mask patterns and leading holes seen from a first face side in Embodiment 1.

A method of manufacturing a substrate for an ink jet head in the present embodiment applies etching masks to both faces of a silicon substrate, forms through holes serving as leading holes in etching regions by, for example, laser beam machining, and then performs anisotropic etching from both the faces. The present embodiment will now be described in detail with reference to FIGS. 4A-4B and 5. FIGS. 4A and 4B are schematic process charts for describing an example of the method of manufacturing a substrate for a liquid discharge head, (a) to (f) of FIG. 4A are sectional views in a 4A-4A line in FIG. 5, and (a) to (f) of FIG. 4B are sectional views in a 4B-4B line. FIG. 5 is a schematic diagram illustrating an example of formation of etching mask patterns and leading holes seen from a first face side.

First, an etching mask material is formed on both faces (first and second faces) of a silicon substrate 1, and a first etching mask pattern 7 and a second etching mask pattern 8 are formed by exposure development ((a) in FIGS. 4A and 4B). The first and second etching mask patterns 7 and 8 have an opening through which the silicon substrate 1 is exposed, and this opening becomes an etching region 10.

Additionally, in order to minimize the opening width of the ink supply hole (liquid supply port) formed by anisotropic etching that is a post step, the opening widths of openings in the first and second etching mask patterns 7 and 8 can be made equal to each other.

Next, through holes serving as the leading holes are formed in the etching region ((b) in FIGS. 4A and 4B). In the present invention, the leading holes are formed and the anisotropic etching is performed from both the faces, so that the difference between the opening widths in the first and second faces can be made small, and the wall surface of the ink supply port can be formed as a stable crystal plane.

Especially, since the etching solution rapidly enters the hole especially by adopting through holes as the leading holes, the etching time can be shortened. Additionally, since it is sufficient if through holes can be formed, it becomes unnecessary to examine detailed condition settings, and the condition settings for the laser become easy.

Although a method of forming the leading holes is not particularly limited if holes can be formed, a laser can be used.

Next, anisotropic etching is performed on the silicon substrate in which the leading holes are formed, thereby forming an ink supply port 6. Views (c) to (f) in FIGS. 4A and 4B illustrate the outline of the progress state of the anisotropic etching. In (f) of FIGS. 4A and 4B, an ink supply port which has a stable crystal plane <111> is formed in the silicon substrate. In the substrate for an ink jet head, the ink supply port has a shape such that the width of a cross-section of the ink supply port increases gradually to a predetermined depth position of the substrate from the opening of the ink supply port at the second face, attains a maximum at a predetermined depth position, and decreases gradually toward the surface of the substrate.

As the etching solution used for anisotropic etching, various well-known alkali etching solutions can be used. For example, a tetramethylammonium hydroxide aqueous solution (20% of concentration) can be preferably used. It is desirable that the temperature during etching is 60 to 100° C.

Embodiment 2

A method of manufacturing a substrate for an ink jet head in the present embodiment applies etching masks to both faces of a silicon substrate, forms non-through holes serving as leading holes alternately in a longitudinal direction in first and second faces by, for example, laser beam machining, and then performs anisotropic etching from both the faces. The present embodiment will now be described with reference to FIGS. 6A, 6B and 7.

First, first and the second etching mask patterns 7 and 8 which have an opening are formed in both the faces of the silicon substrate 1. In order to minimize the opening width of an ink supply hole formed by anisotropic etching that is a post step, the opening widths of openings in the first and second etching mask patterns can be made equal to each other.

Figure 6A:
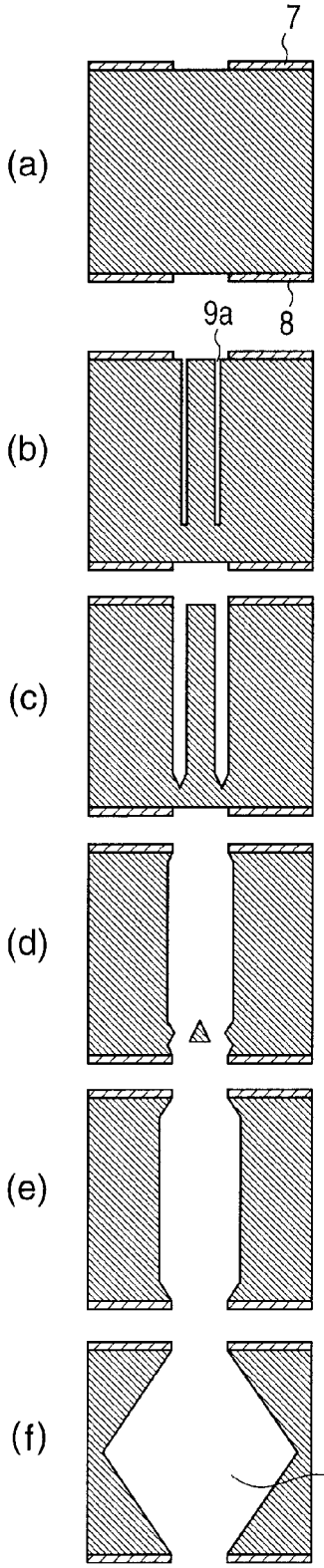
FIGS. 6A and 6B are schematic process charts for describing an example of the method of manufacturing a substrate for a liquid discharge head in Embodiment 2.
Figure 6B:
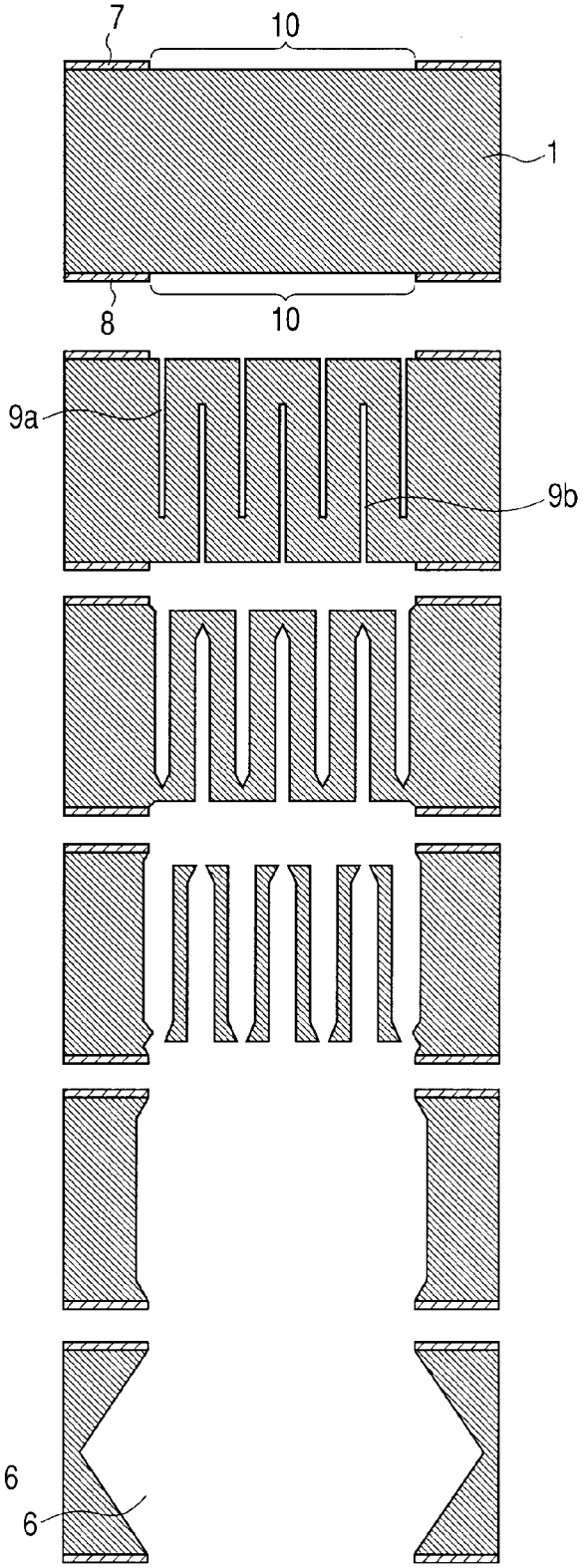

Next, non-through holes as the leading holes are formed in the etching region ((b) in FIGS. 6A and 6B). The first recesses and the second recesses do not communicate with each other, and the bottoms of the first recesses 9*a* are closer to the second face than the bottoms of the second recesses 9*b*. The depth of the non-through holes is preferably made as deep as possible, and the holes are desirably made to near the other surface. Moreover, a crystal plane exposed by the anisotropic etching can be selected by controlling the position and depth of the leading holes suitably. Additionally, the width of the openings can be controlled by controlling the shape of the etching masks.

Figure 7:
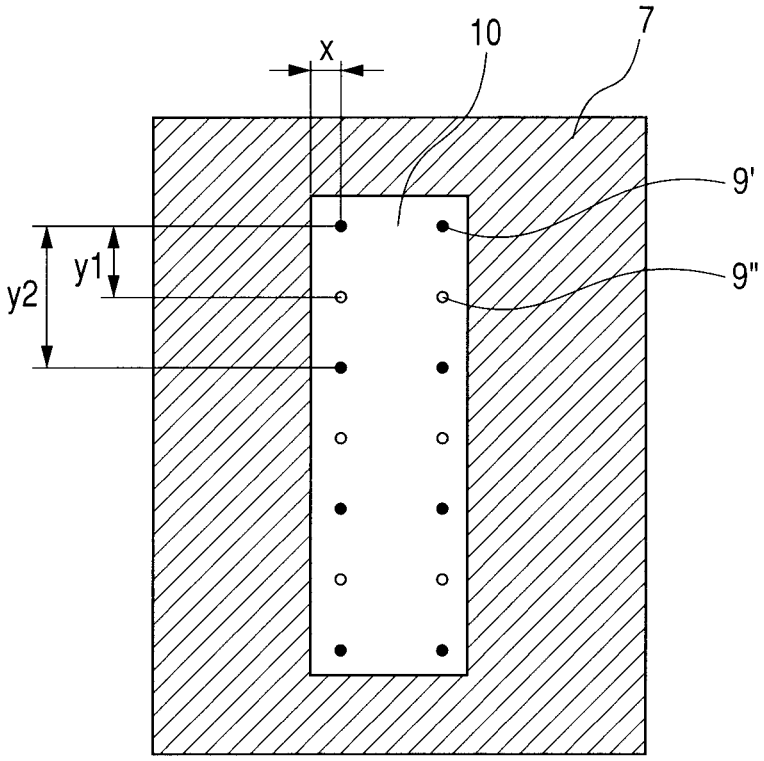
FIG. 7 is a schematic diagram illustrating an example of arrangement of etching mask patterns and leading holes seen from a first face side in Embodiment 2.

Here, an example of arrangement of the leading holes seen from the first face side is illustrated in FIG. 7. In FIG. 7, the leading holes on the side of the first face are designated by 9', and the leading holes on the side of the second face are designated by 9". Additionally, the leading holes 9" on the side of the second face are illustrated on the first face for convenience of description. In the present embodiment, the distance x that is a shortest distance (opening end to leading hole end) between the opening end of an etching mask pattern and the leading holes is desirably set to 40 μm or less. Additionally, the leading holes on the side of the second face can be made at intervals y1 from the leading holes on the side of the first face, and the leading holes on the side of the first face can be made at intervals y2. In the example of FIG. 7, although the leading holes are made so as to satisfy y2=2×y1, this relationship is not necessarily satisfied. Additionally, y1 can be set to 1.0 mm or less. It is desirable that the diameter of the leading holes 9' and 9" is set to 1 μm or more when penetration of an anisotropic etching solution is taken into consideration. Moreover, when the machining difficulty of leading hole forming unit (laser beam machining), and the time required for the machining are takes into consideration, about 10 to 40 μm is desirable. Additionally, the depth of the leading holes 9' and 9" can be set such that the residual thickness of the substrate become about 50 to 300 μm.

Next, anisotropic etching is performed on both the faces of the silicon substrate in which the leading holes are formed, thereby forming an ink supply port 6. Views (c) to (f) in FIGS. 6A and 6B illustrate the outline of the progress state of the anisotropic etching. In view (f) in FIGS. 6A and 6B, an ink supply port which has a stable crystal plane is formed in the silicon substrate.

Embodiment 3

Figure 3:
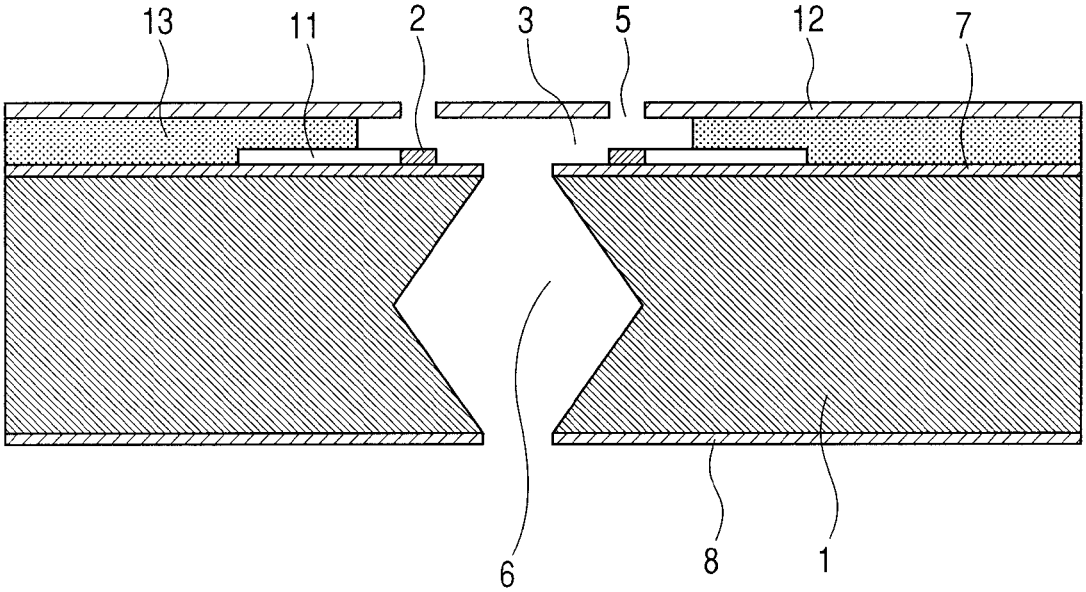
FIG. 3 is a schematic sectional view for describing the configuration of an ink jet head which has a substrate for an ink jet head manufactured by a method of manufacturing a substrate for a liquid discharge head of the present invention.

A cross-section of an ink jet head which has the substrate for an ink jet head manufactured by the manufacturing method of the present invention is illustrated in FIG. 3. The liquid discharge head is provided with a liquid supply port which communicates with discharge ports through which liquid is discharged and which supplies the liquid to a liquid flow channel having a discharge energy generating element for discharging the liquid. An example of the manufacturing method will now be described.

First, a discharge energy generating unit 2 for giving discharge energy to ink and wiring lines 11 for supplying an electric current to the discharge energy generating unit are formed on a substrate for an ink jet head.

Here, a method of fabricating an orifice plate 12 will be described. The orifice plate 12 can be fabricated using, for example, electroforming. The electroforming will now be simply described. First, a mandrel which has a shape complementary to a suitable orifice plate shape is fabricated. This mandrel has moderate draft angle and dimensions for isolation. Next, the orifice plate is removed from the mandrel after a predetermined thickness of nickel is deposited by electroforming performed for a given period of time. Then, the obtained nickel orifice plate 12 is covered with precious metals, such as gold, palladium, and rhodium so as to withstand corrosion.

Meanwhile, the substrate for an ink jet head is formed with a barrier layer 13 for preventing diffusion of ink and diffusion of the pressure generated by the discharge energy generating unit 2 to the periphery of the discharge energy generating unit 2. The barrier layer 13 can be formed, for example, by applying sensitive resin having negative characteristics, exposing ultraviolet rays through a photo mask, and removing a non-exposed portion by a developer.

Next, the ink jet head as illustrated in FIG. 3 can be fabricated by positioning the orifice plate 12 having discharge ports 5 on the barrier layer 13, and pressing and joining the orifice plate under a desired temperature.

Figure 2:
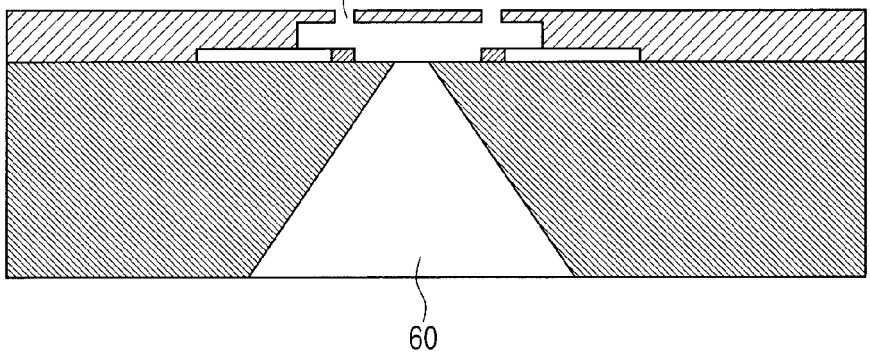
FIG. 2 PRIOR ART
FIG. 2 is a schematic sectional view for describing the cross-sectional shape of an ink supply port formed by a conventional method of manufacturing an ink jet head.

Compared to the ink supply port (FIG. 2) of the ink jet head by the conventional manufacturing method, in the ink jet head using the substrate for an ink jet head by the manufacturing method of the present invention, almost the same opening width as the opening width of the first face is obtained for the opening of the ink supply port of the second face. Additionally, the occupying width in the cross-section of the ink supply port is also smaller than that of the conventional ink supply port. Accordingly, the size of the ink jet head can be reduced by using the substrate for an ink jet head manufactured by the manufacturing method of the present invention. By making the size of the ink jet head small, the number of ink jet heads which can be formed on one wafer can be increased, and the productivity of ink jet heads can be greatly improved.

In addition, the recording onto a recording medium by the ink jet head is performed by supplying an electric current to the wiring lines 11, making an ink droplet filled into the ink flow channel discharged by the pressure generated by a discharge energy generating element 2, and making the ink adhered to the recording medium.

In addition, the ink jet head can be loaded on apparatuses, such as a printer, a copying machine, a facsimile having a communication system, and a word processor having a printer unit, and industrial recording apparatuses combined with various processing apparatuses complexly. Then, recording can be performed on various recording mediums, such as paper, threads, fibers, leather, metal, plastic, glass, timber, and ceramic by using this ink jet head. In addition, in the present invention, the "recording" means not only giving an image with a meaning, such as characters or figures to a recording medium, but also giving an image with no meaning, such as patterns.

Example

An etching mask material was formed on the first and second faces of a silicon substrate 1 which has a thickness of 725 μm and a plane orientation (crystal orientation of the first and second faces)<100>. Next, after a silicon nitride film of about 300 nm is deposited by the LPCVD (Low Pressure Chemical Vapor Deposition) method, dry etching was performed using photolithography, and first and second etching mask patterns were formed ((a) in FIGS. 6A and 6B). Additionally, an etching mask patterns seen from the first face is as being illustrated in FIG. 7. The opening widths of the respective etching mask patterns in the first and second faces were made equal to each other.

Next, the leading holes were made at the positions as illustrated in FIG. 7 by a laser. The leading holes were formed in two rows in the lateral direction of the opening (etching region) 10 of the etching mask pattern. In each row, the distance x from the end of the opening (etching region) 10 of the etching mask pattern was set to 35 μm. Additionally, the spacing y1 of the leading holes on the side of the second face from the leading holes on the side of the first face was set to 150 μm, and the spacing y2 between the leading holes on the side of the first face was set to 300 μm. A laser beam of a triple wave (wavelength of 355 nm) of an Nd:YAG laser was used for the formation of the leading holes, and the diameter of the leading holes was set to about 20 μm. The depth of the leading holes 9 was set to about 600 μm.

Next, the silicon substrate 1 was subjected to anisotropic etching using a tetramethylammonium hydroxide aqueous solution with a concentration of 20% at a temperature of 80° C. The state of progress of the anisotropic etching is illustrated in views (c) to (f) in FIGS. 6A and 6B. The ink supply hole 3 surrounded by the <111> plane that is a crystal plane in which elution into ink does not occur was formed.

Next, the wiring lines 11, the discharge energy generating elements 2, and the barrier layer 13 were formed.

Next, the orifice plate 12 was joined to obtain the ink jet head (FIG. 3). From the foregoing, an ink jet head can be obtained which has the opening width of the second face approximately equal to the opening width of the ink supply port in the first face, is narrow in the occupying width of the ink supply port, and has an ink supply port in which elution of silicone into ink does not occur.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-088965, filed Apr. 1, 2009, which is hereby incorporated by reference herein in its entirety.

What is claimed is:

1. A method of manufacturing a substrate for a liquid discharge head having a supply port which passes through a silicon substrate provided with an energy-generating element which generates the energy used to discharge a liquid and which allows the liquid to be supplied to the energy-generating element therethrough, the method comprising the steps of:

preparing a silicon substrate in which a first etching mask having a first opening is provided on a first face of the silicon substrate, and a second etching mask having a second opening is provided on a second face of the silicon substrate that is a rear face of the first face;

forming a first recess in the silicon substrate towards the second face from the first face within the first opening, and forming a second recess in the silicon substrate towards the first face from the second face within the second opening, a bottom of the first recess being closer to the second face than a bottom of the second recess; and after forming the first recess and the second recess, performing crystalline anisotropic etching to the silicon substrate using the first and second etching masks as masks from both the faces of the first and second faces, thereby forming the supply port.

2. The method of manufacturing a substrate for a liquid discharge head according to claim 1, wherein the lengths of the first opening and the second opening are approximately equal to each other in the lateral direction of the silicon substrate.

3. The method of manufacturing a substrate for a liquid discharge head according to claim 1, wherein the crystal orientation of the first and second faces is <100>.

4. The method of manufacturing a substrate for a liquid discharge head according to claim 1, wherein the first recess and the second recess do not communicate with each other, and the bottom of the first recess is closer to the second face than the bottom of the second recess.

5. The method of manufacturing a substrate for a liquid discharge head according to claim 1, wherein the first recess and the second recess are holes penetrating the silicon substrate, and when the holes are formed, crystalline anisotropic etching is performed to the silicon substrate.

6. The method of manufacturing a substrate for a liquid discharge head according to claim 1, wherein the first recess and the second recess are formed by a laser.

7. The method of manufacturing a substrate for a liquid discharge head according to claim 1, wherein the first recess and the second recess are alternately formed in a longitudinal direction of the silicon substrate.

* * * * *